US007331077B1

(12) United States Patent
Henry

(10) Patent No.: US 7,331,077 B1
(45) Date of Patent: Feb. 19, 2008

(54) MOTORIZED TELESCOPIC CLEANER

(76) Inventor: Mary Henry, 4302 Brandy Ann Ct., Acworth, GA (US) 30101

( * ) Notice: Subject to any disclaimer, the term of this patent is extended or adjusted under 35 U.S.C. 154(b) by 226 days.

(21) Appl. No.: 11/294,199

(22) Filed: Dec. 6, 2005

(51) Int. Cl.
*A46B 13/02* (2006.01)

(52) U.S. Cl. ..... 15/23; 15/28; 15/97.1

(58) Field of Classification Search ..... 15/23, 15/28, 97.1
See application file for complete search history.

(56) References Cited

U.S. PATENT DOCUMENTS

| | | | | |
|---|---|---|---|---|
| 843,590 | A | 2/1907 | Dunn et al. | |
| 2,984,852 | A | 5/1961 | George | |
| 3,407,424 | A | 10/1968 | Lanzarone et al. | |
| 4,217,671 | A | 8/1980 | Rand | |
| 4,345,351 | A | 8/1982 | Moss et al. | |
| D294,073 | S | 2/1988 | Lin | |
| D353,919 | S | 12/1994 | Sajko | |
| 5,511,269 | A | 4/1996 | Watson | |
| 5,781,955 | A | 7/1998 | Hendricks | |
| 7,152,266 | B1 * | 12/2006 | Haughton | 15/28 |
| 2002/0104177 | A1 | 8/2002 | Wong et al. | |
| 2003/0213078 | A1 * | 11/2003 | Kristofek | 15/97.1 |
| 2004/0083567 | A1 * | 5/2004 | Lies | 15/28 |
| 2005/0066458 | A1 * | 3/2005 | Belcastro | 15/28 |

* cited by examiner

*Primary Examiner*—Mark Spisich
(74) *Attorney, Agent, or Firm*—Crossley Patent Law; Mark Ashley Crossley

(57) ABSTRACT

A motorized telescoping cleaner with a plurality of varied attachments that removably attach to the top of the telescoping joints, the joints progressively telescoping such that the length of the invention can extend and contract, a top joint which also features a pivot which bends to 90 degrees from the plane of the remaining joints, the top pivot containing a motor coupled to a flexible drive rod, thereby enabling pivoted drive of attachments. The motor is connected via electrical wire to batteries in the base of the invention. Batteries are both rechargeable and replaceable.

18 Claims, 3 Drawing Sheets

MOTORIZED TELESCOPIC CLEANER

BACKGROUND OF THE INVENTION

With conventional cleaning tools and dusting tools typically provided in fixed lengths, there is a need for a cleaning tool which can both contract and extend, easily, with regard to length. Hard to reach areas, as well as areas that are elevated, typically require a plurality of different tools to accomplish cleaning tasks. Additionally, typical tools are non-moving, that is, they require the user to provide impetus for cleaning. What is needed is a motorized, spinning tool that extends and contracts in length, while at the same time providing for cleaning attachment movement to aid the user in performing cleaning tasks.

FIELD OF THE INVENTION

The invention relates to telescoping cleaning devices and more especially to a motorized telescopic cleaner that also pivots in the top telescoping joint.

SUMMARY OF THE INVENTION

The general purpose of the motorized telescopic cleaner, described subsequently in greater detail, is to provide a motorized telescopic cleaner which has many novel features that result in an improved motorized telescopic cleaner which is not anticipated, rendered obvious, suggested, or even implied by prior art, either alone or in combination thereof.

To accomplish this, the invention comprises a telescoping cleaner that is also motorized to spin the various attachments that removably attach to the top of the telescoping joints. The joints are progressively telescoping such that the length of the invention, in one example, can extend to approximately 12-15 feet. An additional heavy duty example of the invention provides up to 25 feet in total length. The release button and telescoping mechanism of the invention is well known in the art. The telescoping joints are topped by a top joint which also features a pivot. The pivot can bend up to 90 degrees from the plane of the remaining pivots. The top pivot contains a motor which is coupled to a flexible drive rod, thereby enabling pivoted drive of attachments. The motor is connected via electrical wire to batteries in the base of the invention. Batteries are both rechargeable and replaceable. The batteries are longitudinally disposed within the hollow base. The base further comprises an on/off switch for motor operation. The handle of the invention is hollow, both for slideable receipt of the base as well as storage of various cleaning attachments. The screw cap removably retains anything stored within the handle.

Thus has been broadly outlined the more important features of the motorized telescopic cleaner so that the detailed description thereof that follows may be better understood and in order that the present contribution to the art may be better appreciated.

Numerous objects, features and advantages of the motorized telescopic cleaner will be readily apparent to those of ordinary skill in the art upon reading the following detailed description of presently preferred, but nonetheless illustrative, examples of the motorized telescopic cleaner when taken in conjunction with the accompanying drawings. In this respect, before explaining the current examples of the motorized telescopic cleaner in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the motorized telescopic cleaner. It is therefore important that the claims be regarded as including such equivalent constructions insofar as they do not depart from the spirit and scope of the present invention.

Objects of the motorized telescopic cleaner, along with various novel features that characterize the invention are particularly pointed out in the claims forming a part of this disclosure. For better understanding of the motorized telescopic cleaner, its operating advantages and specific objects attained by its uses, refer to the accompanying drawings and description.

DETAILED DESCRIPTION OF THE DRAWINGS

With reference now to the drawings, and in particular FIGS. 1 through 6 thereof, example of the motorized telescopic cleaner employing the principles and concepts of the present invention and generally designated by the reference number 10 will be described.

Figure 1:
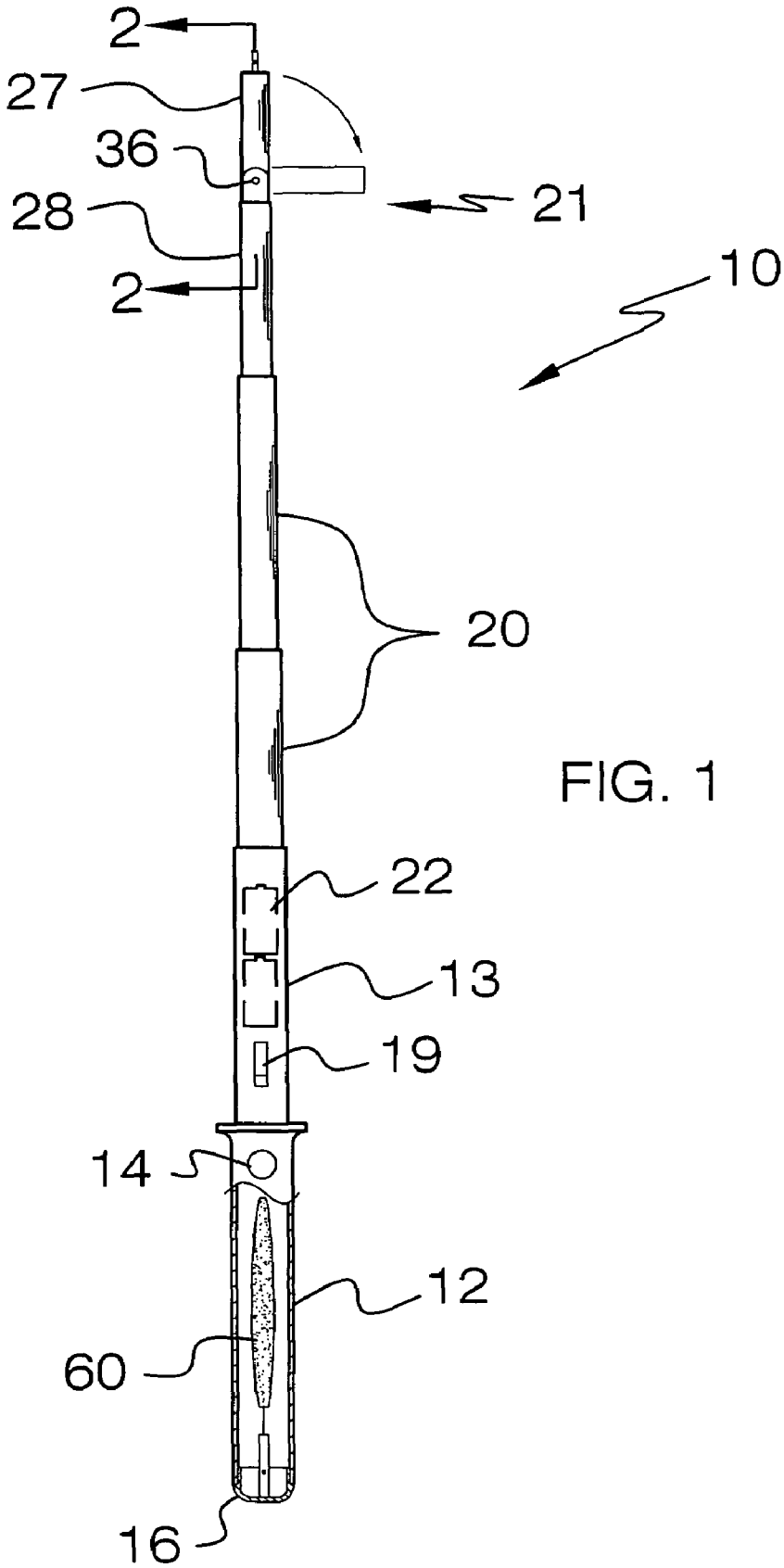
FIG. 1 is a elevation of the invention illustrating control features and pivotal top joint.
Figure 2:
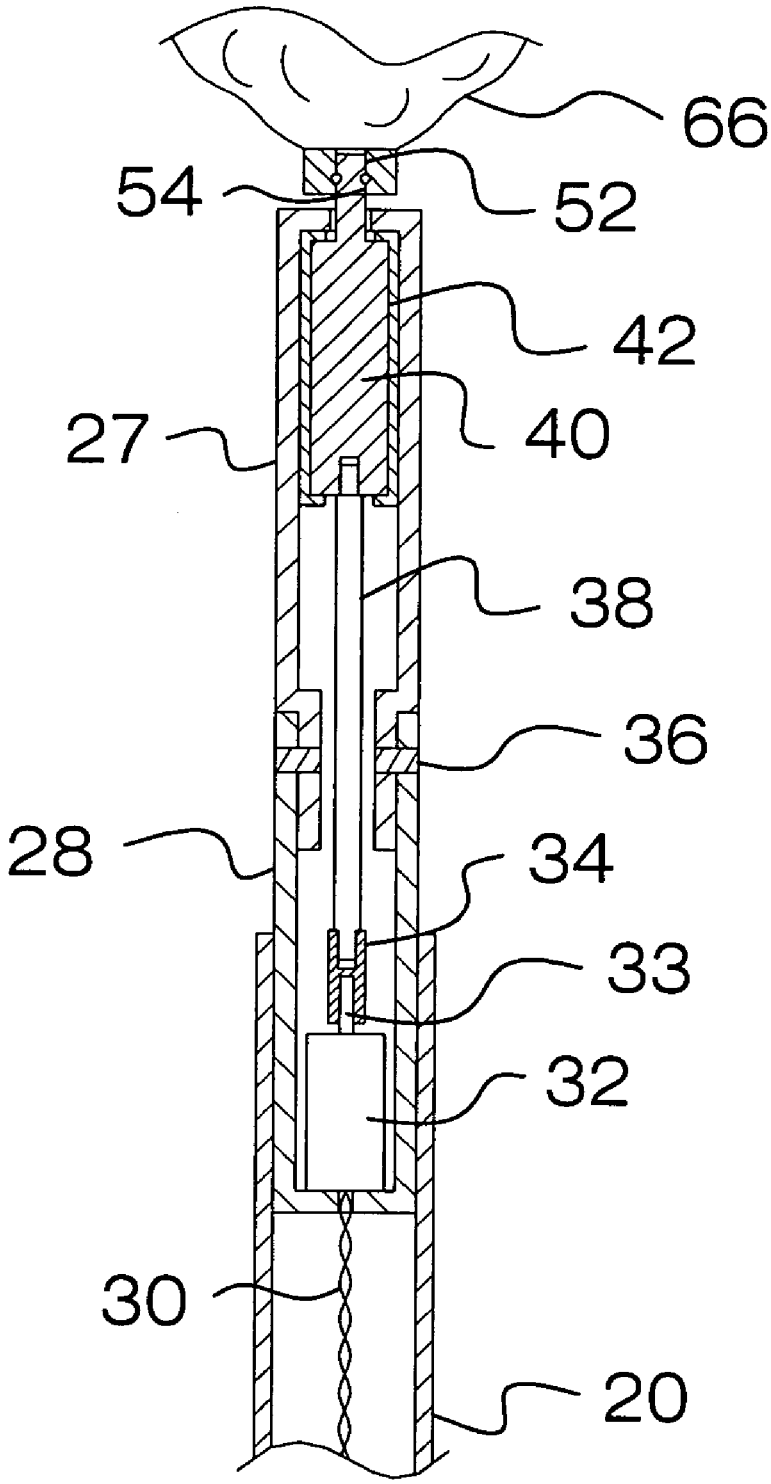
FIG. 2 is a cross sectional view of the top joint of the invention of FIG. 1, taken along the line 2-2.
Figure 3:
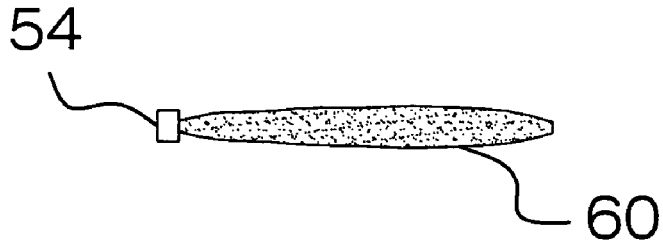
FIG. 3 is a side elevation of the slim brush of the invention.
Figure 4:
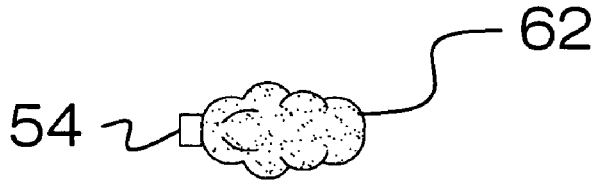
FIG. 4 is a side elevation of the soft brush of the invention.
Figure 5:
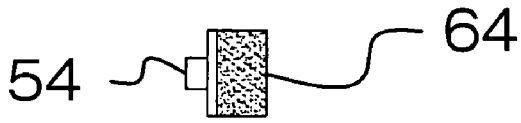
FIG. 5 is a side elevation of the sponge of the invention.
Figure 6:
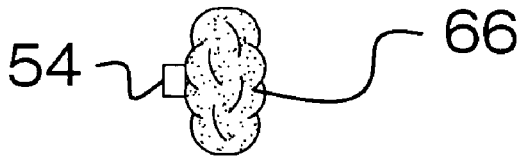
FIG. 6 is a side elevation of the scrub brush of the invention.

Referring to FIGS. 1 and 2, the invention 10 comprises a motorized telescopic cleaner, comprising a hollow handle 12 on the bottom end. The handle 12 further comprises a screw cap 16. The slim brush 60 is removably stored within the hollow handle 12 and selectively retained via the screw cap 16. A tubular base 13 slideably fits within the top of the handle 12. A plurality of tubular telescoping joints 20 are progressively attached upwardly from the base 13. A release button 14 is disposed and accessible in the base 13. The release button 14 releases the telescoping joints 20 by pressing. The joints 20 are thereby positioned in a chosen position of extension. The telescoping mechanism of the cleaner is well known in the art. The motor 32 is disposed within the top telescoping joint 21. The output shaft 33 of the motor 32 extends upwardly from the motor 32. At least one battery 22 is disposed within the base 13. The battery 22 powers the motor 32 via the wire 30. The on/off switch 19 controls the motor 32.

The top telescoping joint 21 further comprises the pivot 36 in an approximate middle of the top joint 21. The upper head 27 of the top joint 21 is above the pivot 36. The lower head 28 of the top joint 21 is below the pivot 36. The flexible drive rod 38 is disposed within the upper head 27 and the lower head 28. The drive rod 38 has a first end and a second end.

The coupler 34 is disposed within the lower head 28. The coupler 34 is connected to the output shaft 33 of the motor 32. The coupler 34 is further connected to the first end of the drive rod 38. A bushing 42 is disposed within the upper head 27. The spin drive 40 is rotatably disposed within the bushing 42. The spin drive 40 has an upper end and a lower end. The lower end of the spin drive 40 is connected to the second end of the drive rod 38. A male keeper 52 is disposed on the upper end of the spin drive 40. The scrub brush 66 is removably affixed atop the spin drive 40. The scrub brush 66 and other attachments are removably fitted atop the male keeper 52 of spin drive via the female receiver 54 of each attachment.

Referring to FIGS. 3 through 6, the attachments of the invention 10 include the slim brush 60, the soft brush 62, the sponge 64 and the scrub brush 66. The invention 10 includes but is not limited to these attachments. The female receiver 54 on each cleaning attachment provides for removable attachment to the male keeper 52 of the spin drive 40.

With respect to the above description then, it is to be realized that the optimum dimensional relationships for the parts of the motorized telescopic cleaner, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A motorized telescopic cleaner, comprising:
- a tubular handle on a bottom end;
- a tubular base slideably fitted within the handle;
- a plurality of telescoping joints progressively attached upwardly from the base;
- a release button in the base, the button for press release of the telescoping joint extensions in a chosen position of extension;
- a motor within a top telescoping joint;
- a power supply in the base, the power supply for the motor;
- communication between the power supply and the motor;
- a drive rod within the top joint, the drive rod having a length;
- a coupler having a top and a bottom, the bottom connecting one end of the drive rod to the motor;
- a spin drive having an upper end and a lower end, the lower end connected to a upper end of the drive rod;
- a tool attachment on the top of the spin drive;
- a plurality of cleaning tools for removable attachment to the spin drive.

2. The invention in claim 1 wherein one cleaning tool comprises a slim brush.

3. The invention in claim 1 wherein the spin drive is surrounded by a bushing.

4. The invention in claim 3 wherein one cleaning tool comprises a slim brush.

5. The invention in claim 4 wherein one cleaning tool comprises a soft, thick brush.

6. The invention in claim 5 wherein one cleaning tool comprises a sponge attachment.

7. The invention in claim 6 wherein one cleaning tool comprises a scrubbing attachment.

8. A motorized telescopic cleaner, comprising:
- a tubular handle on a bottom end;
- a tubular base slideably fitted within the handle;
- a plurality of tubular telescoping joints progressively attached upwardly from the base;
- a release button in the base, the button for press release and locking of the telescoping joint extensions in a chosen position of extension;
- a motor within a top telescoping joint;
- an output shaft of the motor;
- at least one battery in the base, the battery for powering the motor;
- communication between the battery and the motor;
- a pivot in an approximate middle of the top telescoping joint;
- an upper head of the top joint, the upper head above the pivot;
- a lower head of the top joint, the lower head below the pivot;
- a flexible drive rod within the upper head and the lower head, the drive rod having a first end and a second end;
- a coupler disposed within the lower head, the coupler connected to the output shaft of the motor, the coupler further connected to the first end of the drive rod;
- a spin drive disposed within the upper head, the spin drive having an upper end and a lower end, the lower end connected to the second end of the drive rod;
- a tool attachment on the upper end of the spin drive;
- a plurality of cleaning tools for removable attachment to the spin drive.

9. The invention in claim 8 wherein the spin drive is surrounded by a bushing.

10. The invention in claim 9 wherein one cleaning tool comprises a slim brush.

11. The invention in claim 10 wherein one cleaning tool comprises a sponge attachment.

12. The invention in claim 11 wherein one cleaning tool comprises a scrubbing attachment.

13. The invention in claim 8 wherein one cleaning tool comprises a slim brush.

14. The invention in claim 13 wherein one cleaning tool comprises a soft, thick brush.

15. The invention in claim 14 wherein one cleaning tool comprises a scrubbing attachment.

16. A motorized telescopic cleaner, comprising:
- a hollow handle on a bottom end;
- a tubular base slideably fitted within the handle;
- a plurality of tubular telescoping joints progressively attached upwardly from the base;
- a motor within a top telescoping joint;
- an output shaft of the motor;
- at least one battery in the base, the battery for powering the motor;
- communication between the battery and the motor;
- a pivot in an approximate middle of the top telescoping joint;

an upper head of the top joint, the upper head above the pivot;

a lower head of the top joint, the lower head below the pivot;

a flexible drive rod within the upper head and the lower head, the drive rod having a first end and a second end;

a coupler disposed within the lower head, the coupler connected to the output shaft of the motor, the coupler further connected to the first end of the drive rod;

a bushing disposed within the upper head;

a spin drive rotatably disposed within the bushing, the spin drive having an upper end and a lower end, the lower end connected to the second end of the drive rod;

a male keeper on the upper end of the spin drive;

a plurality of cleaning tools for removable attachment to the spin drive;

a female receiver on each cleaning tool, the cleaning tools for removably attachment to the male keeper of the spin drive.

17. The invention in claim 16 wherein the handle is further comprised of a release button, the button for locking and the press release of the joints in a chosen position of extension.

18. The invention in claim 16 wherein the handle is further comprised of a screw cap.

* * * * *